US008484936B2

(12) United States Patent
Tannock

(10) Patent No.: US 8,484,936 B2
(45) Date of Patent: Jul. 16, 2013

(54) SPOOL FOR A WASTE STORAGE DEVICE

(75) Inventor: Robert William Tannock, Nottingham (GB)

(73) Assignee: Sangenic International Limited, Cramlington, Northumberland (GB)

( * ) Notice: Subject to any disclaimer, the term of this patent is extended or adjusted under 35 U.S.C. 154(b) by 753 days.

(21) Appl. No.: 10/480,508

(22) PCT Filed: Jun. 12, 2002

(86) PCT No.: PCT/GB02/02627

§ 371 (c)(1),
(2), (4) Date: Sep. 17, 2004

(87) PCT Pub. No.: WO02/100723

PCT Pub. Date: Dec. 19, 2002

(65) Prior Publication Data

US 2005/0016890 A1 Jan. 27, 2005

(30) Foreign Application Priority Data

Jun. 12, 2001 (GB) ..... 0114312.2

(51) Int. Cl.
*B65B 9/18* (2006.01)

(52) U.S. Cl.
USPC ..... 53/459; 53/390; 53/567; 53/576

(58) Field of Classification Search
USPC ..... 53/438, 459, 469, 567, 568, 575, 53/576, 551, 390
See application file for complete search history.

(56) References Cited

U.S. PATENT DOCUMENTS

| | | | | | |
|---|---|---|---|---|---|
| 182,173 | A | * | 9/1876 | Cussen | 141/390 |
| 435,638 | A | * | 9/1890 | Barnes | 141/341 |
| 617,961 | A | * | 1/1899 | Johnson | 248/97 |
| 918,355 | A | * | 4/1909 | McGowan | 248/94 |
| 3,452,368 | A | * | 7/1969 | Couper | 4/484 |
| 3,536,192 | A | * | 10/1970 | Couper | 206/303 |
| 3,682,371 | A | * | 8/1972 | Saika | 138/119 |
| 3,732,662 | A | * | 5/1973 | Paxton | 53/415 |
| 3,746,159 | A | * | 7/1973 | May | 206/527 |
| 3,908,336 | A | * | 9/1975 | Forslund | 53/576 |
| 3,938,300 | A | | 2/1976 | Lovqvist | |
| 4,133,356 | A | * | 1/1979 | Dillingham | 141/316 |
| 4,191,226 | A | * | 3/1980 | Kyte | 141/391 |

(Continued)

FOREIGN PATENT DOCUMENTS

| | | |
|---|---|---|
| DE | G 93 19 683.0 | 6/1994 |
| DE | 19646165 | 5/1998 |

(Continued)

OTHER PUBLICATIONS

English translation of Hungarian Search Report for Hungarian App. No. P 040 0172.

(Continued)

*Primary Examiner* — Thanh Truong
(74) *Attorney, Agent, or Firm* — Ungaretti & Harris, LLP

(57) ABSTRACT

A spool (10) for storing film for a waste storage device includes a core (12) and a flared funnel portion (14). Film is stored on the core (12) and can be retained in place by shrink-wrapping (34) as a result of which the core can be formed without an outer wall or base, reducing material and molding costs.

9 Claims, 5 Drawing Sheets

U.S. PATENT DOCUMENTS

| | | | | | |
|---|---|---|---|---|---|
| 4,202,075 | A | * | 5/1980 | Michel et al. | 452/38 |
| 4,488,697 | A | * | 12/1984 | Garvey | 248/101 |
| 4,505,003 | A | | 3/1985 | Becker et al. | |
| 4,869,049 | A | * | 9/1989 | Richards et al. | 53/459 |
| 4,934,529 | A | | 6/1990 | Richards et al. | |
| 4,993,210 | A | * | 2/1991 | Kollross | 53/428 |
| 5,045,020 | A | | 9/1991 | Neeff et al. | |
| 5,353,716 | A | * | 10/1994 | Wilbert | 108/150 |
| 5,535,913 | A | | 7/1996 | Asbach et al. | |
| 5,590,512 | A | * | 1/1997 | Richards et al. | 53/567 |
| 5,655,680 | A | | 8/1997 | Asbach et al. | |
| 5,782,061 | A | | 7/1998 | Clazie et al. | |
| 5,813,200 | A | | 9/1998 | Jacoby et al. | |
| 5,871,037 | A | * | 2/1999 | Feldt | 141/391 |
| 5,884,346 | A | * | 3/1999 | Hengl | 4/484 |
| 5,899,049 | A | * | 5/1999 | Fuss et al. | 53/459 |
| 6,065,272 | A | | 5/2000 | Lecomte | |
| 6,128,890 | A | * | 10/2000 | Firth | 53/567 |
| 6,170,240 | B1 | | 1/2001 | Jacoby et al. | |
| 6,212,701 | B1 | * | 4/2001 | He | 4/449 |
| 6,370,847 | B1 | | 4/2002 | Jensen et al. | |
| 6,516,588 | B2 | | 2/2003 | Jensen et al. | |
| 6,612,099 | B2 | | 9/2003 | Stravitz | |
| 6,719,194 | B2 | | 4/2004 | Richards | |
| 6,804,930 | B2 | | 10/2004 | Stravitz | |
| 6,851,251 | B2 | * | 2/2005 | Stravitz | 53/567 |
| 6,901,974 | B2 | | 6/2005 | Chomik et al. | |
| 6,925,781 | B1 | | 8/2005 | Knuth et al. | |
| 6,931,684 | B1 | * | 8/2005 | Henegar | 5/695 |
| 6,941,733 | B2 | | 9/2005 | Chomik et al. | |
| 6,974,029 | B2 | | 12/2005 | Morand et al. | |
| 6,993,891 | B2 | | 2/2006 | Richardson et al. | |
| 7,073,311 | B2 | | 7/2006 | Chomik et al. | |
| 7,100,767 | B2 | | 9/2006 | Chomik et al. | |
| 7,114,314 | B2 | | 10/2006 | Stravitz | |
| 7,114,534 | B2 | | 10/2006 | Chomik et al. | |
| 7,146,785 | B2 | | 12/2006 | Stravitz | |
| 7,178,314 | B2 | | 2/2007 | Chomik et al. | |
| 2002/0078665 | A1 | * | 6/2002 | Salman et al. | 53/459 |
| 2002/0162304 | A1 | | 11/2002 | Stravitz | |
| 2002/0170275 | A1 | | 11/2002 | Salman et al. | |
| 2003/0121923 | A1 | | 7/2003 | Morand et al. | |
| 2003/0131569 | A1 | | 7/2003 | Chomik et al. | |
| 2003/0213804 | A1 | | 11/2003 | Chomik et al. | |
| 2004/0083681 | A1 | | 5/2004 | Stravitz | |
| 2005/0016890 | A1 | | 1/2005 | Tannock | |
| 2005/0183400 | A1 | | 8/2005 | Stravitz et al. | |
| 2005/0183401 | A1 | | 8/2005 | Stravitz et al. | |
| 2005/0188661 | A1 | | 9/2005 | Stravitz et al. | |
| 2005/0193691 | A1 | | 9/2005 | Stravitz et al. | |
| 2005/0193692 | A1 | | 9/2005 | Stravitz et al. | |
| 2005/0274093 | A1 | | 12/2005 | Stravitz et al. | |
| 2006/0032190 | A1 | | 2/2006 | Knuth et al. | |
| 2006/0130438 | A1 | | 6/2006 | Stravitz et al. | |
| 2006/0130439 | A1 | | 6/2006 | Stravitz et al. | |
| 2006/0237461 | A1 | | 10/2006 | Chomik et al. | |
| 2006/0248862 | A1 | | 11/2006 | Morand | |
| 2006/0249418 | A1 | | 11/2006 | Chomik et al. | |
| 2006/0251842 | A1 | | 11/2006 | Chomik et al. | |

FOREIGN PATENT DOCUMENTS

| | | | |
|---|---|---|---|
| EP | 0281355 | A | 9/1988 |
| EP | 0303517 | A | 2/1989 |
| EP | 0 353 922 | A1 | 2/1990 |
| EP | 0 356 051 | A1 | 2/1990 |
| EP | 0 404 484 | A1 | 12/1990 |
| EP | 0 699 584 | A2 | 3/1996 |
| EP | 0 738 657 | A2 | 10/1996 |
| EP | 1364879 | | 11/2003 |
| GB | 1 506 428 | | 4/1978 |
| GB | 2 206 094 | A | 12/1988 |
| GB | GB2206094 | A | 12/1988 |
| GB | 2 221 445 | A | 2/1990 |
| GB | 2 232 951 | A | 1/1991 |
| GB | 2 292 725 | A | 3/1996 |
| HU | P 9203105 | | 9/1992 |
| HU | P9203105 | A | 3/1995 |
| HU | P 0104980 | | 11/2001 |
| HU | P0104980 | A | 8/2003 |
| JP | 50-152890 | A | 12/1975 |
| JP | 54-029272 | | 5/1979 |
| JP | 63-123701 | | 5/1988 |
| JP | 2000247401 | A | 9/2000 |
| JP | 2002-541040 | | 12/2002 |
| JP | 1-158404 | | 9/2004 |
| WO | WO 98/17536 | | 4/1998 |
| WO | WO 99/39995 | A | 8/1999 |
| WO | WO 00/61465 | | 10/2000 |
| WO | 02 20354 | | 3/2002 |

OTHER PUBLICATIONS

Search Report for Hungarian App. No. P 040 0172.

International Search Report for PCT/GB 02/02627 filed Dec. 6, 2002, mailed Feb. 9, 2002.

Search Search Report for GB 01/14312.2 filed Jun. 12, 2001 dated Apr. 8, 2002.

(D11b) Statment by G.W. Wood, Managing Director of Bradley Carter.

* cited by examiner

SPOOL FOR A WASTE STORAGE DEVICE

CROSS-REFERENCE TO RELATED APPLICATIONS

This Application is the U.S. National Stage of International Application No. PCT/GB02/02627, with an international filing date of 12 Jun. 2002, now pending, claiming priority from Great Britain Application No. GB01/14312.2, with a filing date of 12 Jun. 2001, now pending, and herein incorporated by reference.

TECHNICAL FIELD

The invention relates to a spool or cassette for a waste storage device and a method for loading flexible tubing onto such a spool.

BACKGROUND OF THE INVENTION

A known waste storage device is described in UK Patent No. GB 2206094. The device includes a replaceable cassette having an inner, cylindrical core, an outer cylindrical wall and an annular base extending between the two. Layered or pleated tubular film is stored in the cassette and can be drawn over and through the hollow core. The end of the tubing is sealed to form a bag for receiving waste such as an infant's nappy or diaper inserted into the hollow core. The waste is held against rotation relative to the core by resilient fingers provided on the device such that when the core is subsequently rotated the flexible tubing forms a twist seal above the waste and the base of a subsequent bag for receiving further waste. As each item of waste is inserted, the preceding item is thrust down into a receptacle space below the cassette.

A cassette for use in such a device is described in GB 2221445. The cassette includes an annular cap placed over the stored tubing extending from the outer wall part way towards the core and floating on top of the tubing.

GB 2232951 relates to an apparatus for filling a cassette in which the empty cassette is placed on a mandrel, flexible tubing is fed onto the mandrel and compacted into the cassette by a compression ring and the floating annular cap is subsequently fitted in place.

The existing arrangements are highly satisfactory but because of the configuration of the cassette the material costs are high and disposal of an exhausted cassette can be difficult. Furthermore the manufacturing steps required are complex both to load the tubing into the annular space in the cassette and to fit the annular cap. Yet further the extent to which the flexible tubing can be compressed is limited in this configuration providing an attendant lower limit on the size of the cassette itself.

A further improvement to the devices discussed above is known from GB 2292725. This discloses, in addition, a funnel having a lower cylindrical portion and an upper outwardly flared portion. The cylindrical portion is an interference fit inside the top of the cylindrical core of the cassette. Tubing is drawn from the cassette around the funnel and down through the core providing a larger film surface and hence reducing the risk of unwanted soiling.

In practice, however, the funnel can be difficult to fit and can, for example, trap film. In addition the funnel needs to be retrieved and retained when an exhausted cassette is disposed of to be used with a subsequent cassette.

SUMMARY OF THE INVENTION

According to the invention there is provided a spool for storing tubular film having one flared end and an opposing loading end arranged to receive film loaded in a direction towards the flared end. As a result a simple, cheap and easily loadable spool or cassette is provided, allowing increased compaction of film in it. Preferred aspects of the invention are set out in the claims appended hereto.

BRIEF DESCRIPTION OF THE DRAWINGS

Embodiments of the invention will now be described with reference to the drawings of which.

DETAILED DESCRIPTION OF THE INVENTION

Figure 1:
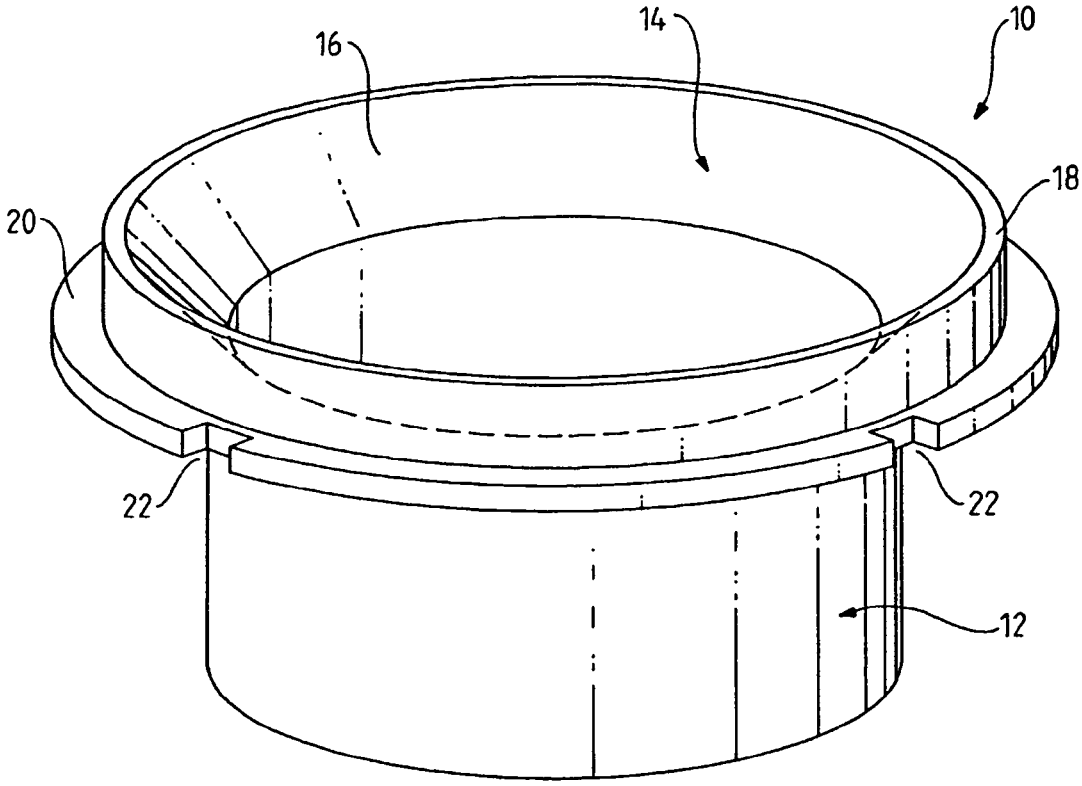
FIG. 1 is a perspective view of a spool according to the invention.

FIG. 1 shows an unloaded spool or bobbin according to the present invention designated generally 10. The cassette includes a core portion 12 and an outwardly flared funnel portion 14. The core portion and funnel portion 14 are integrally formed and can be formed from any appropriate plastics material such as PET and moulded or otherwise formed in any appropriate manner. The funnel portion 14 includes an outwardly flared generally conical part 16, a cylindrical lip 18 depending from the funnel part 16 and concentric with the core 12 and an annular flange 20 extending around the lower end of the lip 18. One or more thumbnail cut-outs 22 are provided in the outer periphery of the annular flange 20.

Figure 2:
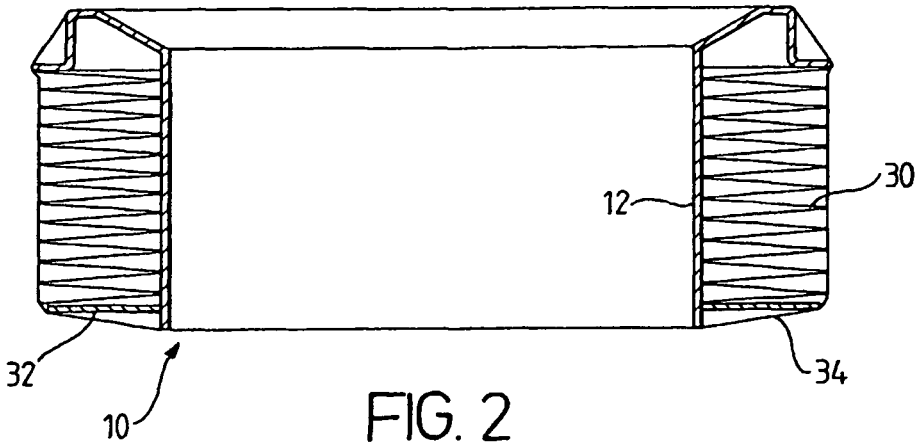
FIG. 2 is a sectional view of a loaded spool.

FIG. 2 shows the spool 10 with a pack of tubular film 30 loaded in a pleated arrangement so as to be drawn off in an axial direction relative to the longitudinal axis of the spool. It will be seen that the pack 30 abuts against the annular flange 20 of the funnel portion 14 at its upper end. In addition a simple annular disc 32 which can be, for example, of plastics material or cardboard terminates the lower end of the tubular film. The arrangement is heat/shrink-wrapped with any appropriate film 34 to hold the pack in place and fully compressed.

Figure 3:
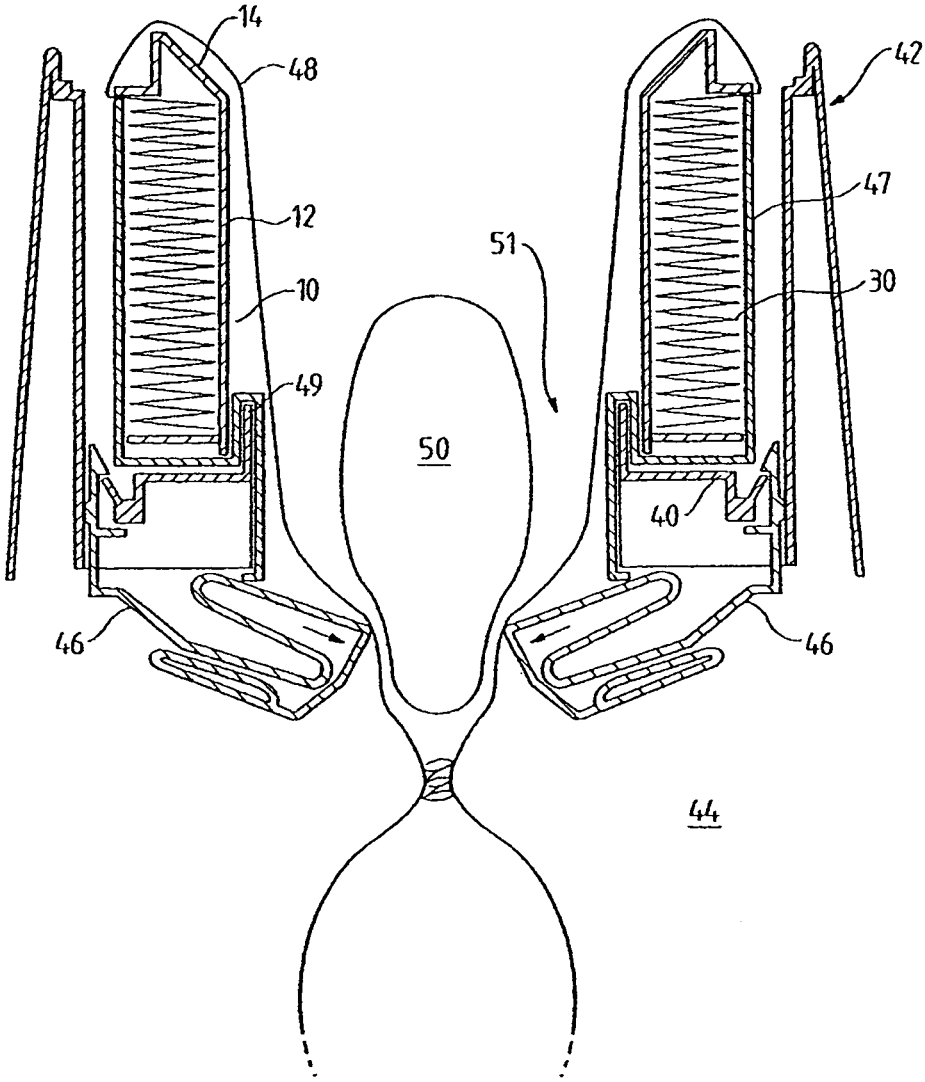
FIG. 3 is a sectional view of a loaded spool inserted in a waste storage device.

Referring to FIG. 3 the cassette is shown in place in a waste disposal device according to a first embodiment. The spool 10 and stored tubing 30 are received on a platform 40 extending inwardly from a disposal device 42 having a storage space 44 and inwardly biased resilient fingers 46. Film 48 from the spool 10 is passed over the funnel portion 14 and down through the core 12. A waste package 50 is shown for illustrative purposes held against rotation by the resilient fingers 46. A cylindrical formation 47 forms an outer wall for the pack of film as well as a base for the spool by virtue of an inwardly directed annular flange which passes over a lip 49 on the inner circumference of the platform 40 and down into the waste throat, clipping over a lower circumference by virtue of a snap-fit to hold the formation 47 in place. The waste storage device works in a conventional manner as discussed above.

Figure 4:
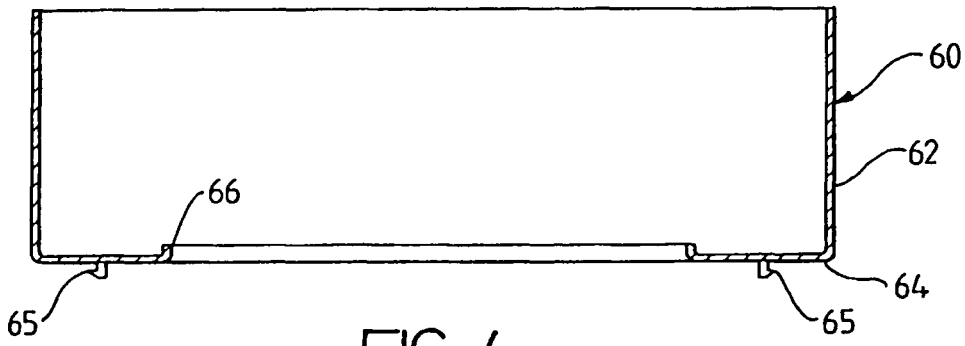
FIG. 4 is a sectional view of a mother cassette for housing the loaded spool.
Figure 5:
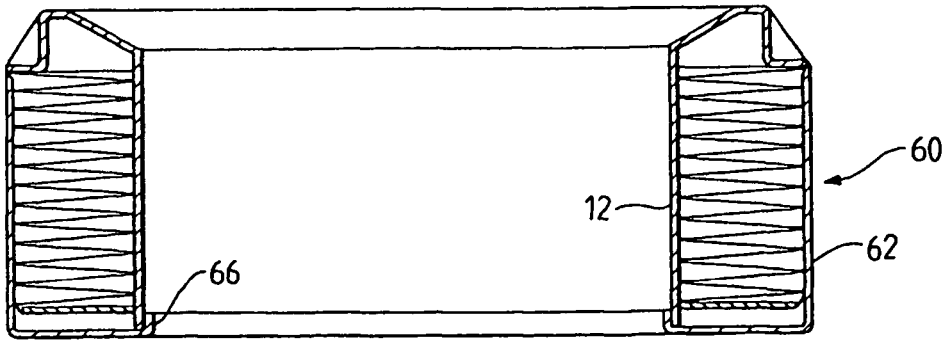
FIG. 5 is a sectional view of a loaded spool housed in a mother cassette.

An alternative mounting arrangement is shown in FIG. 4. According to this arrangement a mother cassette housing 60 is provided comprising an outer cylindrical wall 62 having an open upper face and an inwardly extending flange 64 at its base. The flange 64 has a small upwardly turned inner lip 66 and downwardly depending radial retaining clips 65 for retaining the mother cassette 60 against rotation in a waste storage device. The spool 10 and film 30 is received in the housing 60 which is dimensioned to receive the loaded spool as a snug fit and located by the lip 66 on the mother cassette housing 60 co-acting with the inner surface of the core 12 of the cassette, as shown n FIG. 5. As a result the cassette and mother cassette housing can be loaded into existing disposal devices configured to receive prior art cassettes of the type discussed above.

As a result it will be seen that the spool can be formed without an outer wall or base, reducing material and moulding costs. The floating annular cap is no longer required and the annular disc 32 can be of light-weight cheap material and is simply formed, or can be dispensed with altogether. Because the funnel is integrally formed there is no requirement for the user to fit a funnel nor any risk that the funnel might be lost. Shrink-wrapping of the pack 30 retains the film in a high degree of compression as a result of which the dimensions of the cassette can be reduced or more film can be stored on a single spool. The provision of the thumbnail cut-outs 22 on the funnel portion 16 of the spool allow easy breaking of the shrink-wrap. Furthermore, as discussed below, the end portion of the tubular film 30 can be located in or accessible via the cut-out 22 allowing easy of access for the user to initially pull the tubing over the funnel and through the core. Yet further the funnel acts as a brake on tubular film passing over it removing the need for a complex annular cap for the pack.

Figure 6:
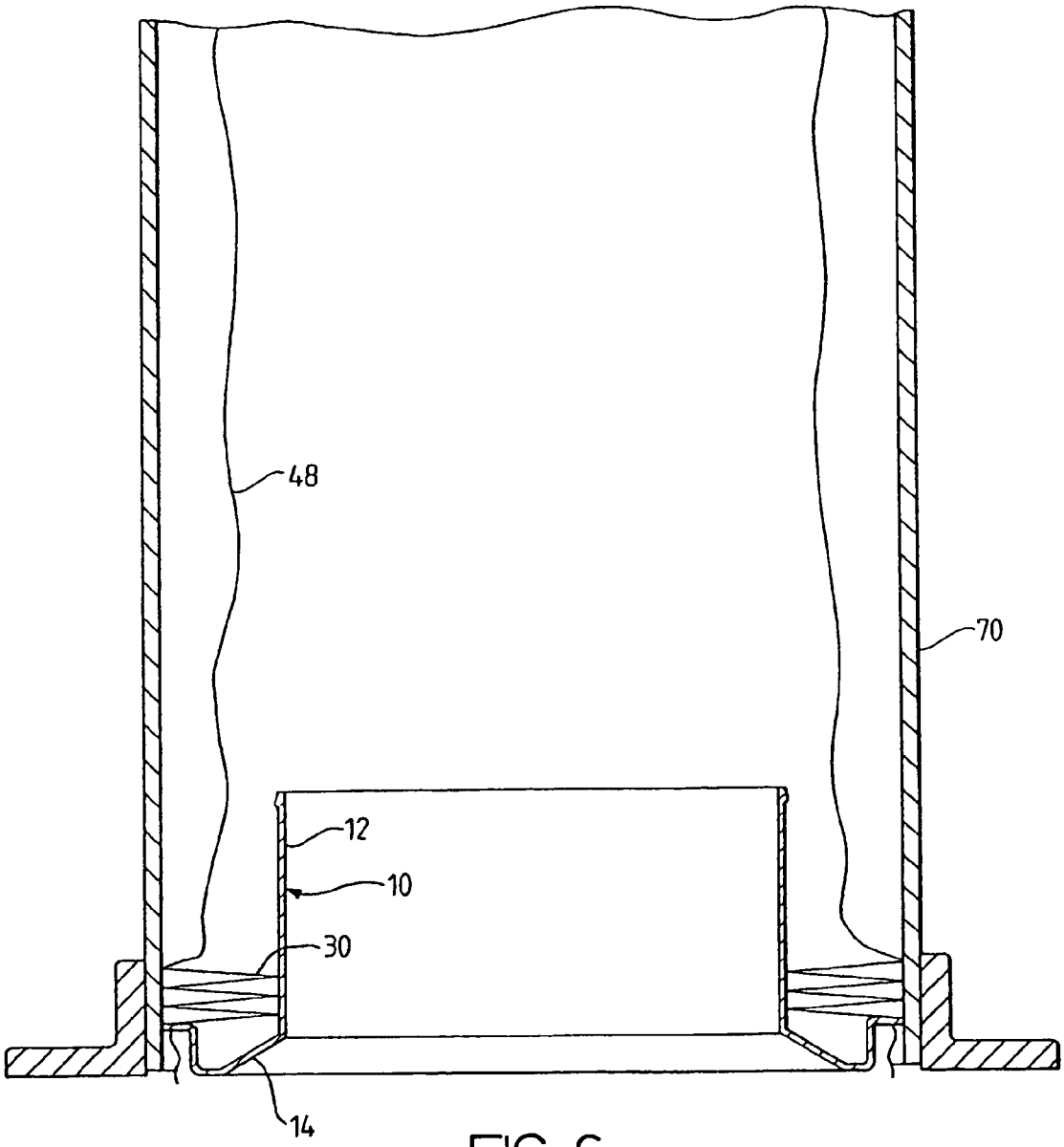
FIG. 6 is a sectional view showing a first stage in the loading process.

Referring now to FIG. 6 a method of loading film 48 onto the spool 10 to form a gathered pack 30 is shown. The spool is located on a platform (not shown) and may be centred by means of a mandrel (not shown) as appropriate. The platform may comprise a number of stations transferable in either a rotary or a linear action to subsequent processing stations. An outer guide tube 70 surrounds the spool 10 defining an outer radius for the pack of tubular film 30, the inner radius being defined, of course, by the core 12. The spool 10 is inverted such that the funnel portion 14 rests on the platform. The film is fed downwardly inside the guide tube 70 in any appropriate manner and forms the pleated pack 30 resting on the funnel portion 14. A vacuum is applied from the underside of the platform to tease a portion of the film through the thumbnail cut-outs 22 allowing it to be easily accessed in use.

Figure 7:
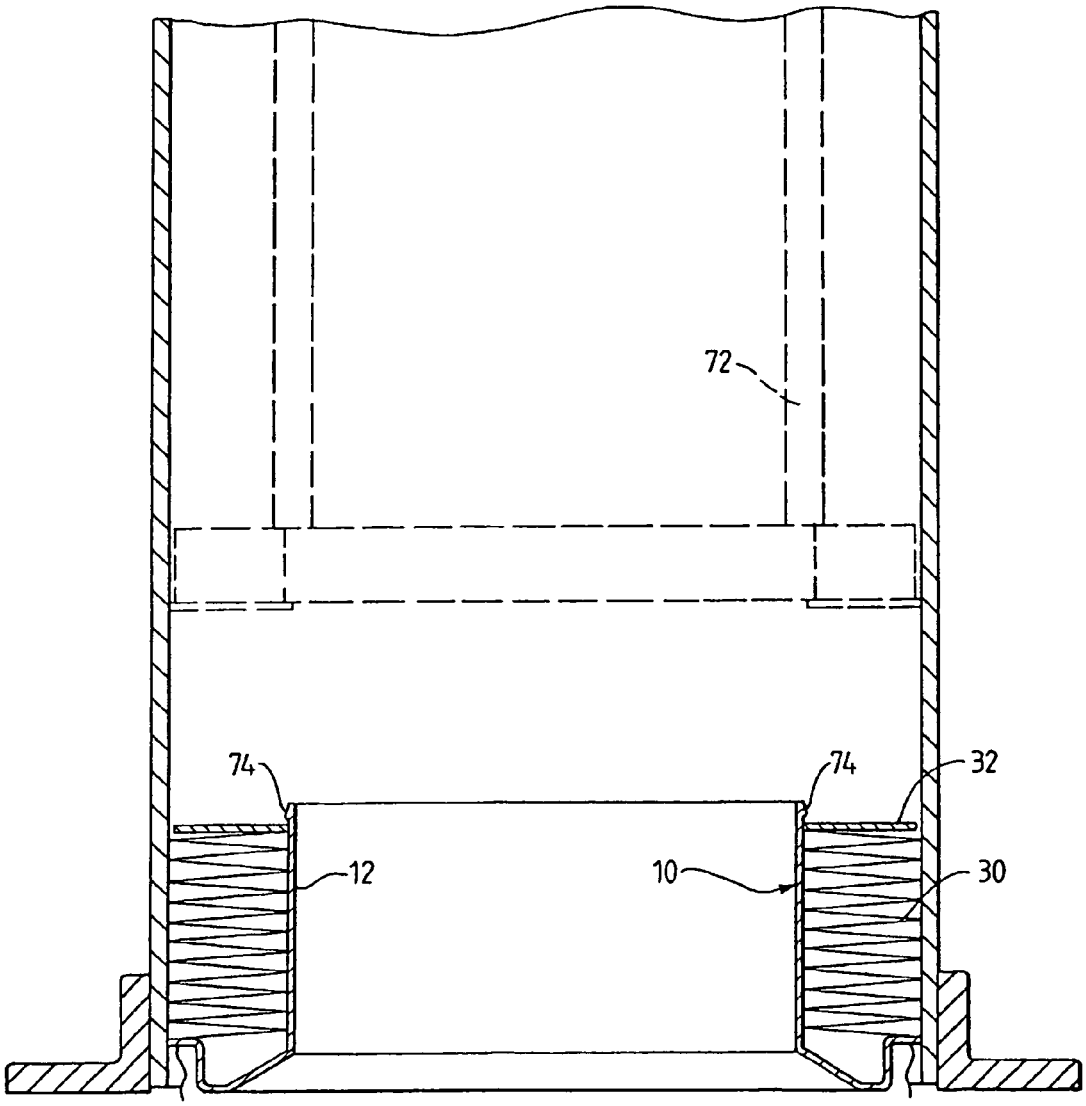
FIG. 7 is a sectional view showing a second stage in the loading process.

Referring now to FIG. 7, once the desired length of tubular film has been fed onto the spool 10 a reciprocating plunger 72 loads the annular disc 32 against the upper face of the pack of film 30, compressing it appropriately. The disc 32 is preferably held in place by a retaining annular bead 74 near the end of the core 12. It will be appreciated that the details of the assembly for loading the cassette will be apparent to the skilled person without the need for a detailed description here. For example a rotary station and feeding arrangement of the type described in GB 2232951 and commonly assigned herewith can be employed and the disclosure of that document is incorporated herein by reference.

The loaded spool is then passed automatically or manually to a heat shrink-wrapping station or other wrapping station to provide a loaded and wrapped spool of the type shown in FIG. 2.

Because of the simplified configuration of the spool according to the present invention, the loading process is simplified. In particular because shrink-wrapping is available by virtue of the omission of the outer wall of the cassette, significantly greater compression of the tubular film is achieved with attendant volume reductions and storage cost improvements.

It will be appreciated that any shape or diameter of core and any type of flared funnel may be adopted and that the spool can be used in waste storage devices of any appropriate kind including domestic and industrial uses as well as personal hygiene and domestic waste applications, and that any appropriate type of tubular film can be adopted dependent on the application.

The invention claimed is:

1. A waste storage device spool comprising a flared end and a non-flared portion, wherein:

the flared end comprises, as a one piece unit, a flared region extending outwardly to a terminating rim of the flared region, and an annular flange extending further outwardly from the terminating rim; and the non-flared portion has a film loading end opposite the flared end; and a tubular film loaded on the non-flared portion and abutting against the annular flange of the flared end.

2. A spool as claimed in claim 1 in which the flared end includes a funnel.

3. A spool as claimed in claim 1 in which the annular flange includes cut-out portions.

4. A spool as claimed in claim 1 further comprising a shrink-wrapping around the spool and tubular film.

5. A spool as claimed in claim 1 further including a spool housing comprising an outer wall arranged to receive the spool and a base arranged to support the spool.

6. A method of loading tubular film onto a waste storage device spool having a flared end and a non-flared portion, the flared end comprising, as a one piece unit, a flared region extending outwardly to a terminating rim of the flared region, and an annular flange extending further outwardly from the terminating rim, the method comprising the steps of:

mounting the spool with a film loading end opposite the flared end disposed towards a film dispenser; and loading the tubular film onto the spool from the film dispenser onto the non-flared portion of the spool, in a direction towards the flared end, such that the loaded film abuts against the annular flange of the flared end.

7. A method as claimed in claim 6 further comprising the step of compressing the loaded film onto the spool.

8. A method as claimed in claim 6 further comprising the step of loading a compression ring against the loaded film.

9. A method as claimed in claim 6 further comprising the step of shrink-wrapping the loaded film and spool.

* * * * *